United States Patent [19]

Tippetts et al.

[11] Patent Number: 4,648,807

[45] Date of Patent: Mar. 10, 1987

[54] COMPACT PIEZOELECTRIC FLUIDIC AIR SUPPLY PUMP

[75] Inventors: Thomas B. Tippetts, Mesa; Michael F. Cycon, Jr., Tempe, both of Ariz.

[73] Assignee: The Garrett Corporation, Los Angeles, Calif.

[21] Appl. No.: 734,003

[22] Filed: May 14, 1987

[51] Int. Cl.[4] ..... F04B 35/04; F04B 45/04

[52] U.S. Cl. ..... 417/322; 417/479; 417/524

[58] Field of Search ..... 417/412, 322, 413, 516, 417/524, 479

[56] References Cited

U.S. PATENT DOCUMENTS

| | | | |
|---|---|---|---|
| 2,152,241 | 3/1939 | Coons . | |
| 2,312,712 | 3/1943 | Hartline . | |
| 2,902,251 | 9/1959 | Oncley . | |
| 2,928,409 | 3/1960 | Johnson et al. . | |
| 2,930,324 | 3/1960 | Toulmin, Jr. . | |
| 3,029,743 | 4/1962 | Johns . | |
| 3,107,630 | 10/1963 | Johnson et al. . | |
| 3,150,592 | 9/1964 | Stec . | |
| 3,270,672 | 9/1966 | Haines et al. . | |
| 3,361,067 | 1/1968 | Webb . | |
| 3,587,328 | 6/1971 | Schuemann . | |
| 3,606,592 | 9/1971 | Madurski et al. . | |
| 3,626,765 | 12/1971 | Moore et al. . | |
| 3,657,930 | 4/1972 | Jacobson . | |
| 3,924,974 | 12/1975 | Fischbeck et al. | 417/322 |
| 3,963,380 | 6/1976 | Thomas, Jr. . | |
| 4,020,700 | 5/1977 | Lopiccolo et al. . | |
| 4,295,373 | 10/1981 | Moffatt . | |
| 4,344,743 | 8/1982 | Bessman et al. . | |
| 4,498,850 | 2/1982 | Perlov et al. | 417/322 |

FOREIGN PATENT DOCUMENTS

| | | | |
|---|---|---|---|
| 709170 | 5/1965 | Canada | 417/480 |
| 47-10131 | 3/1972 | Japan | 417/322 |
| 55-43226 | 3/1980 | Japan . | |
| 605833 | 8/1948 | United Kingdom . | |
| 623016 | 7/1978 | U.S.S.R. | 417/322 |
| 806896 | 3/1981 | U.S.S.R. | 417/322 |

*Primary Examiner*—Carlton R. Croyle
*Assistant Examiner*—Theodore Olds
*Attorney, Agent, or Firm*—Terry L. Miller; Albert J. Miller

[57] ABSTRACT

The piezoelectrically driven diaphragm of an air pump is extended through a chamber and commmunicating outlet passage of the pump's housing. During vibration of the diaphragm, air pulses are alternately expelled through the outlet passage portions positioned on opposite sides of the diaphragm. The air pulses are collected in a rectifying device, carried by the housing, for delivery to a fluidic device or system.

30 Claims, 12 Drawing Figures

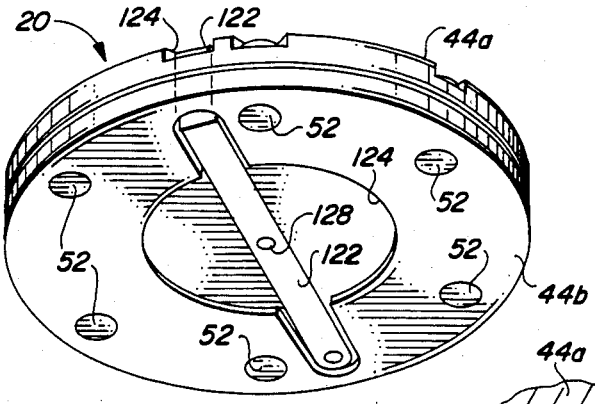
FIG-6
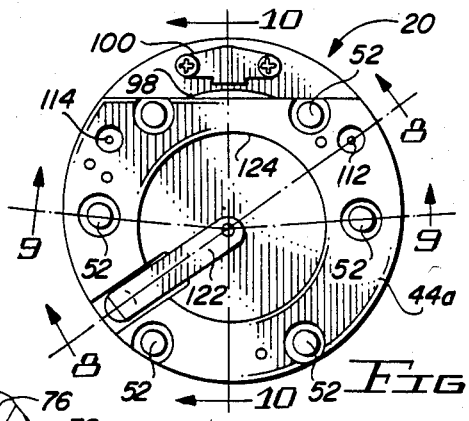
FIG-7
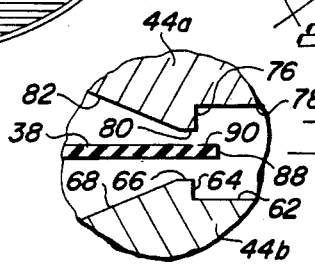
FIG-12
FIG-8
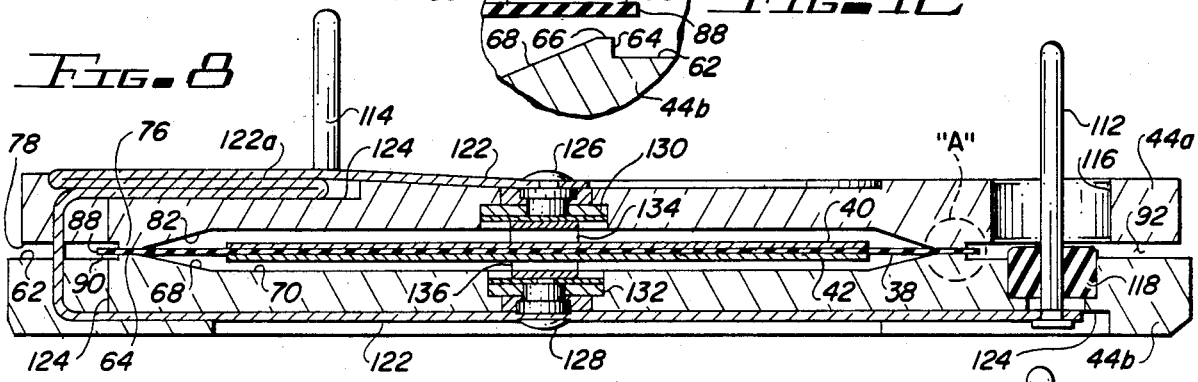
FIG-9
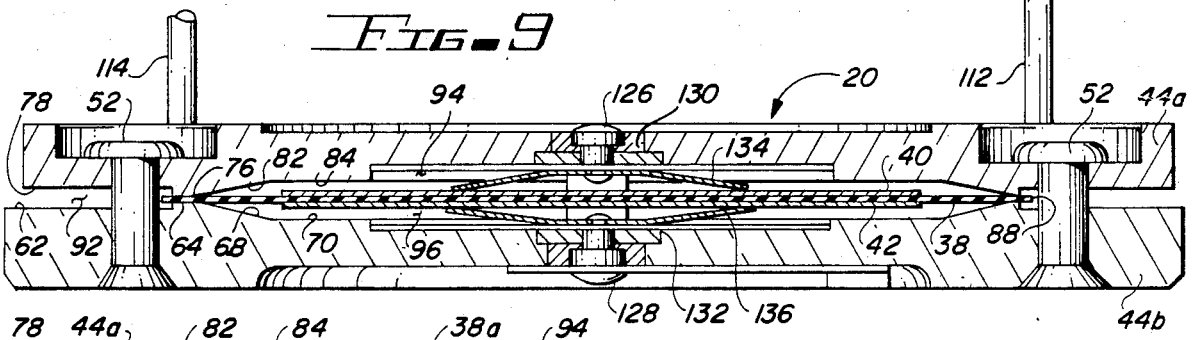
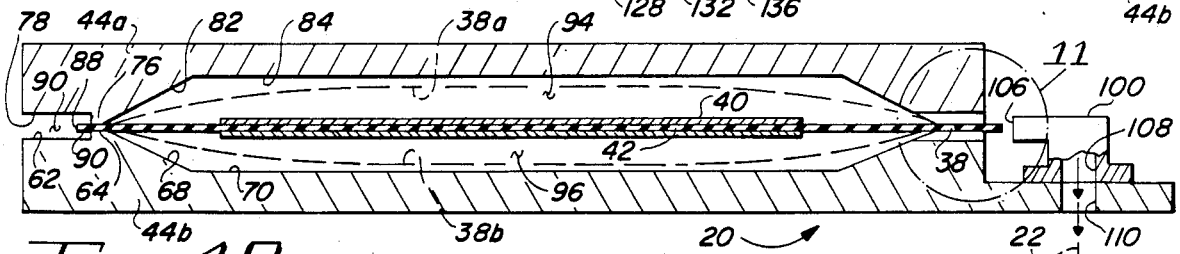
FIG-10
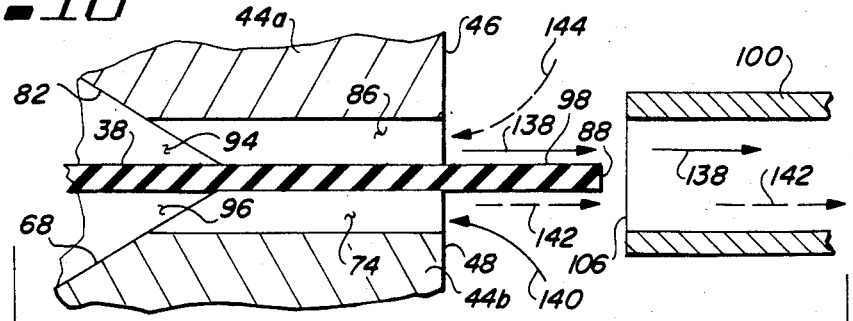
FIG-11

COMPACT PIEZOELECTRIC FLUIDIC AIR SUPPLY PUMP

BACKGROUND OF THE INVENTION

The present invention relates generally to fluid pumping devices, and more particularly provides a uniquely constructed and operative piezoelectric air pump used to deliver supply air to fluidic devices or systems.

Various types of air pumping mechanisms have heretofore been utilized to supply pressurized air to "fluidic" devices—devices which use small, high velocity air jets to perform various control and sensing functions, as opposed to more conventional mechanical or electrical control and sensing devices. However, for a variety of reasons, none of these prior pumping mechanisms has proven to be entirely satisfactory in fluidic air supply applications.

As an example, solenoid-operated reciprocating diaphragm pumps have been utilized. This type of pump, though fairly simple in construction, has the disadvantages, in fluidic applications, of undesirable low frequency operation pressure ripple, and acceleration sensitivity due to the relatively high diaphragm mass required.

Piezoelectrically driven diaphragm pumps have, for some time, been considered as possible alternatives to electromagnetically driven pumps due to the well-known piezoelectric drive characteristics of lighter weight, greater frequency response and considerably smaller size. However, in practice, the utilization of piezoelectric drives in fluidic air supply pumps has heretofore not resulted in wholly satisfactory structural simplicity, compactness, supply flow characteristics or pumping efficiency.

Accordingly, it is an object of the present invention to provide a piezoelectric fluidic air supply pump having, compared to conventional piezoelectric air pumps, improved structural and functional characteristics.

SUMMARY OF THE INVENTION

In carrying out principles of the present invention, in accordance with a preferred embodiment thereof, a compact piezoelectric fluidic air supply pump is provided which comprises first and second housing members, and a diaphragm member having piezoelectric elements secured, in an opposite polarity relationship, to opposite side surfaces thereof. Each of the housing members has a centrally positioned surface depression formed therein and an outlet channel extending between the depression and the exterior surface of the housing member.

With these depressions and channels of the two housing members facing each other in an aligned relationship, the diaphragm member is clamped between the housing members in a position such that it completely separates the depression and outlet channel of one housing member from the depression and outlet channel of the other housing member.

When an alternating electrical current is impressed upon the oppositely disposed piezoelectric elements the diaphragm member is caused to laterally vibrate within the assembled housing. This vibration creates alternate outward and inward air pulses through each of the diaphragm-separated outlet channels. An air receiver is provided to capture and collect the outward air pulses, and create therefrom a pulsating air supply stream for delivery to a fluidic device or system.

According to a feature of the invention, a peripheral portion of the diaphragm member is extended outwardly of the housing, between the facing outlet channels, and serves as a baffle to prevent air being expelled through either channel from being drawn into the housing through the other channel.

According to another feature of the invention, the performance of the pump is substantially improved by clamping the diaphragm member between the housing members only around a peripheral portion of the diaphragm member spaced inwardly from its peripheral edge.

BRIEF DESCRIPTION OF THE DRAWINGS

FIG. 6 is a bottom perspective view of the assembled pump depicted in FIG. 3;

FIG. 7 is a reduced scale top plan view of the pump;

FIG. 8 is a greatly enlarged scale cross-sectional view taken through the pump along line 8—8 of FIG. 7;

FIG. 9 is a greatly enlarged scale cross-sectional view taken through the pump along line 9—9 of FIG. 7;

FIG. 10 is a partially schematic, greatly enlarged scale cross-sectional view taken through the pump along line 10—10 of FIG. 7, with certain interior portions of the pump being omitted for descriptive purposes, and illustrates the vibratory deflections of the diaphragm member within the pump housing;

FIG. 11 is a cross-sectional enlargement of area "11" in FIG. 10; and FIG. 12 is an exploded cross-sectional enlargement of area "A" in FIG. 8.

DETAILED DESCRIPTION

Figure 1:
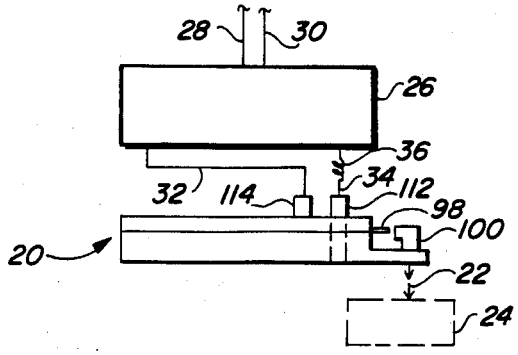
FIG. 1 is a schematic diagram depicting a piezoelectric air pump embodying principles of the present invention, and a current inverter used to power the pump.

Schematically illustrated in FIG. 1 is a compact piezoelectric air pump 20 which embodies principles of the present invention and is used to supply a rapidly pulsating air stream 22 to a fluidic device or system 24. Pump 20 is electrically driven by a suitable current inverter 26 which receives direct current, via leads 28 and 30, and supplies alternating current to the pump via leads 32 and 34, lead 34 having a tuned inductor 36 therein. The inverter is utilized in typical fluidic applications where only DC electrical power is available. If, however, AC electrical power is available, the inverter 26 may be omitted and AC power can be supplied directly to the pump through the leads 32, 34.

Figure 2:
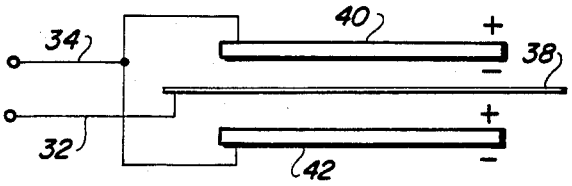
FIG. 2 is a simplified circuit diagram illustrating the electrical connections to the diaphragm and piezoelectric portions of the pump.

As subsequently described in greater detail, the pump 20 includes a thin, disc-shaped metal diaphragm member 38 (FIGS. 2 and 4) having smaller diameter piezoelectric discs 40 and 42 coaxially secured in mutually reversed polarity to its opposite side surfaces. Via other structural elements, AC lead 34 is connected to the piezoelectric discs 40, 42, and AC lead 32 is connected to the diaphragm 38 (FIG. 2).

STRUCTURE OF THE PUMP 20

Figure 3:
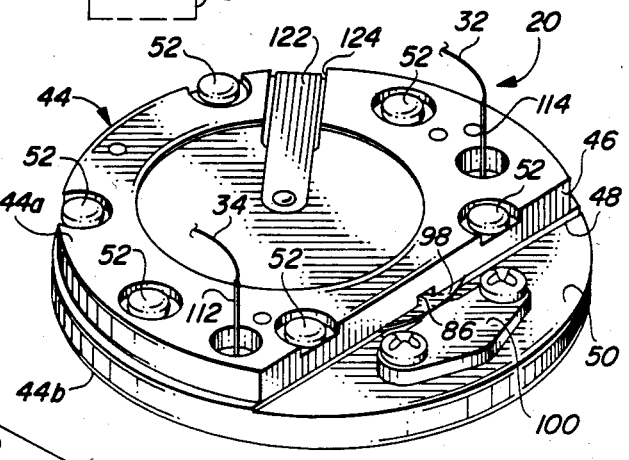
FIG. 3 is a top perspective view of the assembled pump.
Figure 4:
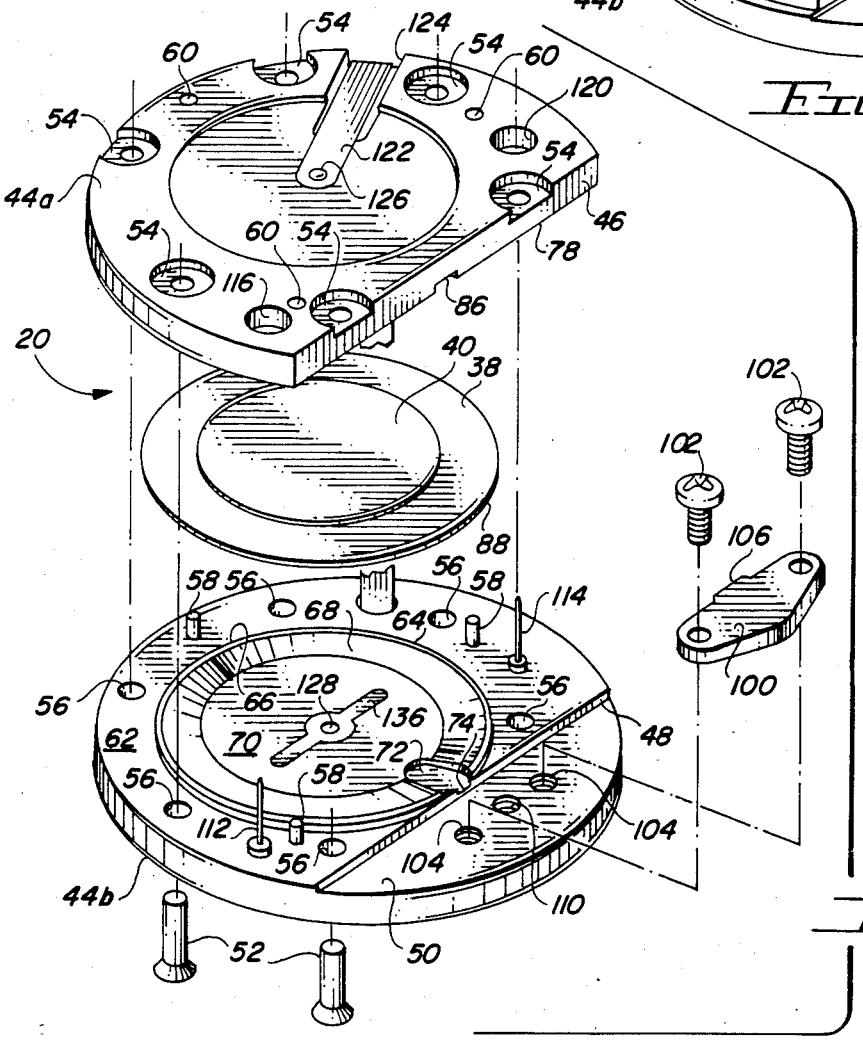
FIG. 4 is an exploded perspective view of the pump.

Referring now to FIGS. 3 and 4, in addition to the diaphragm 38 and piezoelectric discs 40 and 42, the pump 20 also includes a compact metal housing 44 having a generally disc-shaped upper member 44*a* and a generally disc-shaped lower member 44*b*. Housing member 44*a* is truncated to define a flattened edge 46, while an upper end portion of housing member 44*b* is similarly truncated to define a flattened edge 48 which projects upwardly from a ledge portion 50 of the lower housing member.

The two housing members are clamped together, with the flattened edges 46, 48 in alignment, by suitable fastening means such as rivets 52 that extend through openings 54, 56 respectively formed in the housing members 44*a*, 44*b*. Alignment of the flattened edges 46, 48 is facilitated by a circumferentially spaced series of alignment pins 58 which are received in corresponding openings 60 formed in the upper housing member 44*a*. Pins 58 project upwardly from the inner surface 62 of the lower housing member 44*b*.

A cylindrical boss 64 also projects upwardly from inner surface 62, along a generally central portion thereof. At the periphery of the upper end of boss 64 is a narrow, upwardly facing annular flattened edge 66 (FIGS. 4 and 12). From the edge 64 the upper end of boss 64 is recessed along a sloping, annular surface 68 which terminates at a circular flat surface 70. A channel 72 is cut into the upper end of boss 64 and extends from the flat surface 70, upwardly along the sloped surface 68, and opens outwardly through the flattened edge 48 via a necked channel outlet 74 of rectangular configuration.

Referring now to FIGS. 9 and 12, the upper housing member 44*a* also has cylindrical boss 76 which projects downwardly from its inner surface 78 along a central portion thereof. Boss 76 is of identical configuration to, and aligned with, the lower boss 64, having an annular flattened edge 80, a sloping annular surface 82, and a circular flat central surface 84. As in the case of the lower boss 64, the upper boss 76 has a channel (not illustrated) which extends from the central surface 84, downwardly along the sloped annular surface 82 and opens outwardly through the flattened edge 46 (FIGS. 4 and 11) via a necked channel outlet 86 of rectangular configuration.

The piezoelectric disc 38 is coaxially clamped between the aligned end surfaces 66, 80 of the bosses 64, 76 in a unique manner which significantly enhances the air delivery and various other operating characteristics of the pump 20. This coaxial relation between disc 38 and the boss surfaces 64, 80 is maintained by the alignment pins 58 which prevent the disc from shifting relative to the boss ends.

Specifically, the disc 38 is clamped only around an annular portion positioned inwardly of its peripheral edge 88. As can be seen in FIGS. 8–10 and 11, the diameter of disc 38 is slightly larger than the diameters of bosses 64, 76 so that an annular portion 90 of the disc projects outwardly of the side surfaces of the bosses. This peripheral portion of the piezoelectric disc is totally unrestrained, being disposed within an annular housing void 92 positioned between the spaced apart inner side surfaces 78, 62 of the upper and lower housing members 44*a*, 44*b*. Similarly, the entire central portion of disc 38 is unrestrained, being positioned inwardly of the boss clamping surfaces 64, 76 in the facing boss recesses defined by surfaces 82, 84 and 68, 70.

With the pump housing assembled as shown, the piezolectric disc 38 divides and separates the facing boss end recesses (which collectively define an interior housing chamber) into an upper subchamber 94 and a lower subchamber 96 (FIGS. 10 and 11). Moreover, as can be best seen in FIGS. 3 and 11, the disc 38 divides and separates the facing channel outlets 74, 86 (which collectively define a chamber outlet) and has a portion 98 which projects outwardly of the aligned housing member truncated surfaces 46, 48.

Closely adjacent this projecting disc portion 98 is an air receiving member 100 (FIGS. 3, 4 and 11) which is secured to the lower housing member ledge 50 by screws 102 received in threaded openings 104 in the ledge 50. Air receiver 100 has an inlet 106 and an outlet 108 (FIG. 10) which is in registry with an outlet opening 110 (FIGS. 4 and 10) that extends through the housing ledge 50. The receiver inlet 106 faces the aligned channel outlets 74, 86 and extends axially beyond each of the opposite sides surfaces of disc 38.

To receive alternating current from the conversion system 26, terminals are provided in the form of a power pin 112 and a ground pin 114, pin 112 being connected to AC lead 34, and pin 114 being connected to AC lead 32. As can best be seen FIG. 9, power pin 112 extends downwardly through a relatively large diameter opening 116 formed in the upper housing member 44*a*, and is anchored at its lower end to a bushing 118. The bushing 118 is carried by the lower housing member 44*b* and insulates the power pin 112 from the metal housing.

Figure 5:
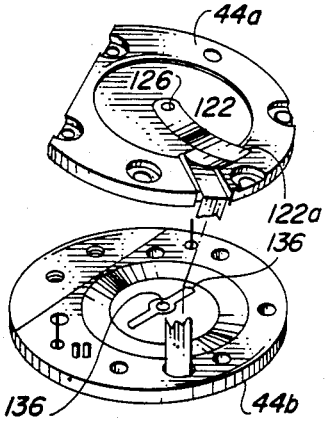
FIG. 5 is a smaller scale exploded perspective view of the two-piece pump housing.

The lower end of the power pin 112 is connected to one end of a flat insulated wire 122 (FIG. 9). From its end connection to power pin 112 the wire 122 is extended along a recess 124 which begins at the lower end of power pin and continues along the underside of housing member 44*b*, upwardly through each housing member adjacent their peripheries and across the upper side surface of housing member 44*a*. The opposite end of wire 122 is connected to a metal stud 126, while a central portion of the wire is connected to a metal stud 128. A portion of the wire 122 adjacent its upper end (FIG. 9) is folded over on itself, as at 122*a*, to facilitate separation of the housing members 44*a*, 44*b* during disassembly, as best illustrated in FIG. 5.

Stud 126 is received in a bushing 130, carried by a central portion of upper housing member 44*a* (FIG. 9), which insulates the stud from the metal housing. In a similar manner, the stud 128 is received in a centrally disposed bushing 132 carried by the lower housing member 44*b*. The inner end of stud 126 is connected to a central portion of an elongated, flexible metal conductor element 134 disposed within subchamber 94, and the inner end of stud 128 is connected to a central portion of an elongated, flexible metal conductor element 136 disposed within subchamber 96. The ends of conductor 134 are bent downwardly into biased engagement with piezoelectric element 40, while the ends of conductor 136 are bent upwardly into biased engagement with piezoelectric element 42.

As can be see in FIGS. 8 and 9, the foregoing structure defines between the power and ground pins 112, 114 an electrical current path extending from power pin 112 through the wire 122 to the studs 126, 128, from the studs to the piezoelectric elements 40, 42 through the conductors 134, 136, and from the piezoelectric elements to the ground pin via the metallic disc 38 and the housing members 44*a*, 44*b*. Such structure also provides for uniquely advantageous operation of the pump 20 which will now be described.

OPERATION OF THE PUMP 20

Referring now to FIGS. 8–10, when alternating current is supplied to the power and ground pins 112, 114 via leads 32, 34, the opposite polarity piezoelectric elements 40, 42 cause rapid vibratory lateral deflection of the disc 38 (also referred to herein as "diaphragm means") within the pump housing interior between the upper and lower deflected positions 38*a*, 38*b* indicated by dashed lines in FIG. 10. It should be noted that during such lateral vibration of the disc 38, constant contact is maintained between the flexible conductors 134, 136 and the piezoelectric elements 40, 42 which they engage. Specifically, as the disc 38 is deflected upwardly, the opposite ends of conductor 134 are forced further apart while sliding along piezoelectric element 40, and the opposite ends of conductor 136 move closer together while sliding along piezoelectric element 42. The sliding movement of the conductors is reversed as the disc is deflected toward its downward position 38*b*.

The described vibration of the disc 38 causes alternate compression and expansion of the housing subchambers 94, 96. As the disc deflects upwardly, a high velocity burst of air 138 (FIG. 11) is expelled outwardly through the channel outlet 86 from the subchamber 94. Due to its relatively high kinetic energy, the air 138 is forced directly into the closely adjacent receiver inlet 106. Simultaneously, ambient air 140 is drawn into the expanding subchamber 96. As the deflective direction of the disc 38 reverses, the direction of air flow through the channel outlets 74, 86 is also reversed, causing a high velocity burst of air 142 to be expelled from channel outlet 86. Like its alternating counterpart 138, the air burst 142 is forced into the receiver outlet 106, such air bursts 138, 142 collectively forming the pulsating air stream 22 used as supply air for the fluidic device or system depicted in FIG. 1.

At this point several very advantageous features of the pump 20 should be noted. First, the vibrating diaphragm means 38 create two usable supply air streams (138 and 142) during each complete vibrational cycle of such diaphragm means. This is, of course, far more efficient than a variety of conventional diaphragm pumps which can generate a supply air flow only when the particular diaphragm is moving in a single one of its two deflectional direction (i.e., creating only a single burst of supply air during its entire vibrational cycle).

Secondly, the use of each of the outlets 74, 76 to supply air to the receiver 100 is achieved without the use of check valve mechanisms of any sort - each of the channels 74, 86 is totally unrestricted. This significant structural simplification vis a vis conventional diaphragm pump construction is achieved in part by a unique dual use of the disc 38. Specifically, the disc is not only used to divide and separate the subchambers 94, 96 and the air outlets 74, 86, but its projecting portion 98 also serves as an air flow baffle interposed between the channel outlets 74, 86 and the receiver inlet 106. Such baffle substantially prevents the supply air burst 138 from being drawn back into outlet 74, and the supply air burst 142 from being drawn back into outlet 86. It also causes the receiver 100 to function, in effect, as a simple fluidic rectifier, helping to guide the air bursts 138, 142 into the receiver inlet 106 while assisting in preventing reverse flow outwardly through such inlet 106.

In developing the present invention it was discovered that by clamping the disc 38 only around an annular area positioned inwardly of its peripheral edge, a surprisingly large performance improvement was achieved in the pump 20 in comparison to the conventional method of simply clamping the disc at its periphery. The cause of this unexpected performance enhancement is believed to be that such inward clamping, along the very narrow annular boss end surfaces 66, 80, provides at least a very limited degree of flexural freedom for the unclamped peripheral area of the disc 38 relative to the unrestrained central portion of the disc. In developing the present invention it was also discovered that this performance improvement could be maintained over a wide temperature range by closely matching the thermal coefficient of expansion of the metal housing members 44*a*, 44*b*, to that of the metal disc 38.

From the foregoing it can be seen that the present invention provides a fluidic air supply pump which eliminates or minimizes a variety of problems and limitations commonly associated with conventional diaphragm and other type pumps proposed for use in fluidic applications. The pump 20 is very compact, relatively simple and inexpensive in construction, light in weight, rugged and efficient—all of which make it particularly well suited to the fluidic air supply applications for which it is intended.

The foregoing detailed description is to be clearly understood as given by way of illustration and example only, the spirit and scope of this invention being limited solely by the appended claims.

We claim:

1. A piezoelectric fluidic air supply pump comprising:

(a) first and second generally disc-shaped housing members each having:

(1) an axially projecting portion having a depression formed in a central portion of the distal end thereof, (2) a peripheral edge having a flattened portion, and (3) a channel extending from said depression to open outwardly in an outlet on said flattened peripheral edge portion, (b) a generally disc-shaped diaphragm member; and (c) a duality of piezoelectric elements secured to opposite side surface portions of said diaphragm member and being electrically drivable to cause lateral vibration of said diaphragm member, a peripheral portion of said diaphragm member being clamped between said axially projecting portions of said first and second housing members and extending across said depressions and channels thereof, said channels being in congruent alignment with one another, an unclamped portion of said diaphragm extending outwardly to separate said channels throughout their length from said depressions at least to said outlets, an annular peripheral portion of said diaphragm member being unrestrained.

2. An air supply pump so recited in claim 1 wherein said axially projecting portions are cylindrical bosses each having a flattened annular peripheral surface at the distal end in place, said flatted peripheral surfaces being in a facing, aligned relationship.

3. An air supply pump as recited in claim 1 further comprising means for receiving alternating electrical current to drive said piezoelectric elements.

4. An air supply pump as recited in claim 3 wherein said means for receiving alternating electrical current include first and second terminals carried by said housing members, and means defining an electrical current path extending from said first terminal through said piezoelectric elements to said diaphragm member, and from said diaphragm member to said second terminal via said housing members.

5. An air supply pump as recited in claim 4 wherein said means defining an electrical current path include a duality of flexible conductors each positioned in one of said depressions and contacting one of said piezoelectric elements, and wiring interconnecting said flexible connectors and said first terminal.

6. An air supply pump as recited in claim 1 wherein said peripheral edges of said housing members are in alignment, and said diaphragm member has a portion which projects outwardly beyond said aligned peripheral edges of said housing members.

7. An air supply pump as recited in claim 6 further comprising an air receiver having on inlet and carried by one of said housing members, said inlet facing said aligned peripheral edges and being closely adjacent said projecting portion of said diaphragm member, said air receiver further being positioned to receive air expelled from both of said channels.

8. Air pump apparatus comprising:

(a) a flat diaphragm member having a peripheral edge;

(b) first and second housing members each having:

(1) a periphery;

(2) a depression positioned inwardly of said periphery, and (3) a channel extending from said depression outwardly through said periphery to open in an outlet thereon;

(c) means for clamping said diaphragm member between said first and second housing members in a manner such that:

(1) only a portion of said diaphragm member positioned inwardly of said peripheral edge thereof is restrained, and (2) an unclamped portion of said diaphragm member extends to said outlets between and continuously separates said channels of said first and second housing members, said channels each being immediately adjacent and extending along opposite side surfaces of said flat diaphragm member; and (d) means for utilizing an external power source to cause lateral vibration of said diaphragm member to thereby create alternate outward expulsions of air through said first and second housing member channels.

9. Air pump apparatus as recited in claim 8 further comprising means for receiving said outward air expulsions and converting the same to a pulsating air supply stream.

10. Air pump apparatus as recited in claim 9 wherein said means for receiving and converting include an air receiver carried by one of said housing members and having an inlet positioned to receive said alternate air expulsions from each of said first and second housing member channels.

11. Air pump apparatus as recited in claim 8 wherein said means for utilizing an external power source include a duality of piezoelectric elements operatively secured in an opposite polarity relationship to opposite sides of said diaphragm member.

12. Air pump apparatus as recited in claim 11 wherein said means for utilizing an external power source include means for impressing an alternating electrical current on each of said piezoelectric elements.

13. Air pump apparatus as recited in claim 8 wherein said diaphragm member and said housing members each have a substantially identical coefficient of thermal expansion.

14. Air pump apparatus as recited in claim 8 wherein each of said housing members has a raised central portion in which one of said depressions is formed, and wherein said means for clamping include said raised central portions, said diaphragm member being clamped between said raised central portions.

15. Air pump apparatus as recited in claim 14 wherein said raised central portions are cylindrical bosses each having, at its distal end, an axially facing annular flat peripheral surface circumscribing one of said depressions, said diaphragm member being clamped between said annular distal end surfaces of said bosses.

16. A method of supplying air to a fluidic device, said method comprising the steps of:

(a) providing a housing having a chamber and an outlet passage communicating with said chamber and opening outwardly on the housing in an outlet;

(b) securing a diaphragm member within said housing so that said diaphragm member extends through, and completely divides into two opposite portions, said chamber and said outlet passage;

(c) utilizing an unrestrained portion of said diaphragm extending outwardly from said chamber through said outlet passage at least to said outlet to divide said outlet passage into said two opposite portions;

(d) causing vibration of said diaphragm member to create alternate outward air pulses through the divided outlet passage portions;

(e) collecting the alternate air pulses; and (f) delivering the collected air pulses to the fluidic device.

17. The method of claim 16 wherein said securing step is performed by restraining said diaphragm member around only a portion thereof positioned inwardly of its periphery.

18. The method of claim 16 wherein said vibration causing step is performed by operatively securing piezoelectric elements to opposite sides of said diaphragm member and supplying alternating electrical current to each of said piezoelectric elements.

19. Air supply pump apparatus comprising:

(a) housing means having a chamber therein and an outlet passage communicating with said chamber; and (b) diaphragm means dividing each of said chamber and said outlet passage into first and second portions, said first and second chamber portions, respectively, opening outwardly through said first and second outlet passage portions, said diaphragm means being vibratable to cause alternate compression and expansion of each of said first and second chamber portions to thereby create alternate outward expulsions of air through said first and second outlet passage portions, said diaphragm means having a peripheral edge and being restrained by said housing means only along a surface area positioned inwardly of said peripheral edge.

20. Air supply pump apparatus as recited in claim 19 further comprising means for collecting said expulsions of air and creating therefrom a pulsating air supply for delivery to a fluidic device.

21. Air supply pump apparatus as recited in claim 20 wherein said diaphragm means include a disc-shaped diaphragm member having a portion which projects outwardly through said outlet passage, and wherein said collecting means include an air receiver carried by said housing means, said air receiver having an inlet which faces said outlet passage and is closely adjacent said outwardly projecting portion of said diaphragm member.

22. A fluidic air supply pump comprising:

(a) a duality of generally disc-shaped housing members each having:

(1) an axially facing side surface, (2) a truncated portion defining a flattened edge surface, and (3) a cylindrical boss projecting axially from a central portion of said side surface, said boss being generally tangential to said flattened edge surface and having at its distal end a recessed portion bounded by a narrow, axially facing flat annular peripheral surface having an outer diameter, said recessed portion having formed therein a channel with an outlet extending through said flattened edge surface;

(b) a metallic disc having opposite side surfaces and a diameter greater than the outer diameters of said annular peripheral end surfaces of said bosses;

(c) a duality of piezoelectric elements secured, in an opposite polarity relationship, to said opposite side surfaces of said metallic disc along a central portion thereof;

(d) fastening members joining said housing members with said peripheral boss end surfaces being in a facing, aligned relationship and said flattened edge surfaces of said housing members being aligned, said metallic disc being coaxially clamped between said flat peripheral surfaces of said bosses around only an annular area positioned inwardly of its periphery, a portion of said metallic disc extending between said channel outlets and projecting outwardly of said flattened edge surfaces of said housing members;

(e) a duality of flexible electrical conductor members positioned on opposite sides of said metallic disc within said recessed portions of said boss, each conductor member being operatively connected to one of said piezoelectric elements;

(f) first and second terminals for receiving alternating electrical current from a source thereof, said first terminal being insulated from said housing members, and said second terminal being grounded to one of said housing members;

(g) wiring interconnecting said first terminal with said flexible conductors; and (h) an air receiver carried by one of said housing members, said air receiver having an inlet and an outlet, said inlet being adjacent said projecting metallic disc portion and facing said channel outlets, said inlet extending axially beyond each of said side surfaces of said metallic disc.

23. Air supply pump apparatus comprising:

(a) housing means having a chamber therein and an outlet passage communicating with said chamber; and (b) diaphragm means, extending through and completely dividing said chamber and said outlet passage into first and second portions and being vibratable between first and second deflected positions, for alternately:

(1) expelling air from said first portion of said chamber outwardly through said first portion of said outlet passage, while drawing air inwardly through said second portion of said outlet passage into said second portion of said chamber, during movement of said diaphragm means toward said first deflected position thereof, and (2) expelling air from said second portion of said chamber outwardly through said second portion of said outlet passage, while drawing air inwardly through said first portion of said outlet passage into said first portion of said chamber, during movement of said diaphragm means toward second deflected position thereof;

said housing means further including first and second housing members, and said diaphragm means including a metal disc having a peripheral edge, said metal disc being clamped between said first and second housing members only around an annular portion spaced inwardly from said peripheral edge.

24. Air supply pump apparatus comprising:

(a) housing means having a chamber therein and an outlet passage communicating with said chamber; and (b) diaphragm means, extending through and completely dividing said chamber and said outlet passage into first and second portions and being vibratable between first and second deflected positions, for alternately:

(1) expelling air from said first portion of said chamber outwardly through said first portion of said outlet passage, while drawing air inwardly through said second portion of said outlet passage into said second portion of said chamber, during movement of said diaphragm means toward said first deflected position thereof, and (2) expelling air from said second portion of said chamber outwardly through said second portion of said outlet passage, while drawing air inwardly through said first portion of said outlet passage into said first portion of said chamber, during movement of said diaphragm means toward said second deflected position thereof;

wherein a portion of said diaphragm means projects outwardly of said housing means through said outlet passage, said apparatus further comprising an air receiver carried by said housing means and having an inlet and an outlet, said inlet being adjacent said projecting diaphragm means portion and facihg said outlet passage to receive air expelled therefrom.

25. Air supply pump apparatus as recited in claim 24 further comprising means for utilizing electrical energy from a source thereof to cause vibration of said diaphragm means.

26. Air supply pump apparatus as recited in claim 25 wherein said housing means are metal, said diaphragm means include a metal disc, and said means for utilizing electrical energy include:

(1) first and second terminals carried by said housing means for receiving alternating electrical current, said first terminal being insulated from said housing means and said second terminal being grounded thereto, (2) a duality of piezoelectric elements secured in opposite polarity to opposite sides of said metal disc, (3) a duality of flexible conductors each positioned in said chamber and slidably engaging one of said piezoelectric elements, and (4) wiring interconnecting said first terminal and said piezoelectric elements.

27. Air pump apparatus comprising:

(a) a flat diaphragm member having a peripheral edge;

(b) first and second housing members each having:

(1) a periphery;

(2) a depression positioned inwardly of said periphery, and (3) a channel extending from said depression outwardly through said periphery;

(c) means for clamping said diaphragm member between said first and second housing members in a manner such that:

(1) only a portion of said diaphragm member positioned inwardly of said peripheral edge thereof is restrained, and (2) said diaphragm member extends between and separates said channels of said first and second housing members, said channels each being immediately adjacent and extending along opposite side surfaces of said flat diaphragm member; and (d) means for utilizing an external power source to cause lateral vibration of said diaphragm member to thereby create alternate outward expulsions of air through said first and second housing member channels;

said air pump apparatus further comprising means for receiving said outward air expulsions and converting the same to a pulsating air supply stream;

said means for receiving and converting including an air receiver carried by one of said housing members and having an inlet positioned to receive said alternate air expulsions from each of said first and second housing member channels; and said air pump apparatus further comprising means defining a baffle interposed between said channels and said air receiver inlet for substantially preventing air being expelled from one of said channels from being drawn into the other of said channels.

28. Air pump apparatus as recited in claim 27 wherein said diaphragm member has a portion which projects outwardly from said channels, and wherein said means defining a baffle comprise said outwardly projecting diaphragm member portion.

29. The method of claim 28 wherein said collecting step includes providing an air receiver having an inlet and an outlet, and mounting said air receiver on said housing so that said inlet faces said outlet and is closely adjacent said outwardly projecting portion of said diaphragm member.

30. A method of supplying air to a fluidic device, said method comprising the steps of:

(a) providing a housing having a chamber and an outlet passage communicating with said chamber;

(b) securing a diaphragm member within said housing so that said diaphragm member extends through, and completely divides into two opposite portions, said chamber and said outlet passage;

(c) causing vibration of said diaphragm member to create alternate outward air pulses through the divided outlet passage portions;

(d) collecting the alternate air pulses;

(e) delivering the collected air pulses to the fluidic device; and (f) wherein said securing step includes positioning said diaphragm member so that a portion thereof projects outwardly of said housing through said outlet passage.

* * * * *

UNITED STATES PATENT AND TRADEMARK OFFICE

CERTIFICATE OF CORRECTION

PATENT NO. : 4,648,807

DATED : March 10, 1987

INVENTOR(S) : Thomas B. Tippetts, Michael F. Cycon, Jr.

It is certified that error appears in the above-identified patent and that said Letters Patent is hereby corrected as shown below:

On the title page, the filing date "May 14, 1987" should read --[22] Filed: May 14, 1985--.

Signed and Sealed this

Fourth Day of February, 1992

*Attest:*

HARRY F. MANBECK, JR.

*Attesting Officer*

*Commissioner of Patents and Trademarks*